US005614928A

United States Patent [19]

Matsuda

[11] Patent Number: 5,614,928

[45] Date of Patent: Mar. 25, 1997

[54] METHOD AND PRINTER FOR PRINTING HEAT SEALING LABELS

[75] Inventor: Yasuhiko Matsuda, Iwate-ken, Japan

[73] Assignee: Kabushiki Kaisha Sato, Japan

[21] Appl. No.: 326,313

[22] Filed: Oct. 20, 1994

[30] Foreign Application Priority Data

Oct. 22, 1993 [JP] Japan ..... 5-287515

[51] Int. Cl.[6] ..... B41J 2/01

[52] U.S. Cl. ..... 347/2; 347/102; 156/277; 156/385

[58] Field of Search ..... 347/102, 2; 156/277, 156/384, 385, 386, 387

[56] References Cited

U.S. PATENT DOCUMENTS 5,041,846 8/1991 Vincent et al. ..... 347/102

*Primary Examiner*—Valerie Lund

*Attorney, Agent, or Firm*—Ostrolenk, Faber, Gerb & Soffen, LLP

[57] ABSTRACT

A method for printing heat sealing labels comprises the steps of using an ink jet printer to print ink onto a printing surface of a heat sealing label strip having the printing surface on a first side and having on a second side a surface coated with an adhesive, and heating the heat sealing label strip to fuse the adhesive on the second side to an adhesive, tacky state and simultaneously dry the ink printed on the printing surface on the first side. A printer for carrying out the method comprises an ink jet printer for printing ink onto a printing surface of a heat sealing label strip having the printing surface on a first side and having on a second side a surface coated with an adhesive, and a heater for simultaneously fusing the adhesive on the second side to an adhesive, tacky state and drying ink printed on the printing surface on the first side by the printer.

43 Claims, 3 Drawing Sheets

METHOD AND PRINTER FOR PRINTING HEAT SEALING LABELS

BACKGROUND OF THE INVENTION

1. Field of the Invention

This invention relates to a method and a printer for printing heat sealing labels, more particularly, to a method and a printer optimized for printing product names, dates, bar codes and the like on heat sealing labels.

2. Description of the Prior Art

Adhesive coated labels come in two general types. In one type, a large number of labels are provisionally attached to a backing strip whose surface has been treated with silicone and the labels are individually peeled off the backing strip and attached to the objects to be labeled. In the other type, known as the heat sealing label, the back surfaces of the labels are coated with an adhesive and the labels are attached to the objects to be labeled after the adhesive has been heated and fused into an adhesive state by a heater.

Since the first-mentioned type uses a backing strip which has to be disposed of after the labels have been peeled off, it is both expensive and wasteful of natural resources. In contrast, the heat sealing label has the major advantages of being low in cost and environmentally friendly.

Up to now, however, heat sealing labels have been used only by the method of printing them with a printer beforehand and then, at the time of use, fusing their adhesive to an adhesive state with heat before applying them to the objects to be labeled. Specifically, it has not been possible to print heat sealing labels using a label printer of the thermal or thermal transfer type. This is because the 60°–80° C. melting point of the carbon ink used as printing ink in thermal and thermal transfer printers is lower than the 80°–100° C. melting point of the adhesive of a heat sealing label. The carbon ink printing on a label printed with a thermal or thermal transfer printer would therefore melt and be degraded if heated to the temperature required to fuse the adhesive of a heat sealing label.

In addition, the melting of the adhesive of cut heat sealing labels takes time because it has to be conducted by surface heating with the label held stationary.

In view of the considerable merits of the heat sealing label in terms of cost and resource saving potential, however, a need exists for the development of a label printer able to print heat sealing labels.

Many recent word processors, computer printers and the like adopt ink jet printers that use nozzles for jetting ink onto the printing surface. The ink used in ink jet printers is made easier to jet from fine nozzles by adding to it a wetting agent that lowers its viscosity. Since the added wetting agent prolongs the time required for the printed ink to dry, however, the ink tends to blot, degrading the quality of the printing.

Because of this, adoption of the ink jet method for the printing of product names, dates, bar codes and the like on labels would lead to various problems. In the absence of some effective countermeasure, the long time required for the ink to dry would be a particular problem in the case of printing bar codes, which cover a large area and need several times longer than ordinary characters to dry. As a result, the label processing speed would be lowered. In addition, there would still be the problem of printing degradation by ink blotting.

Based on a careful study of the heat sealing label technology and the ink jet printing method technology, the inventor discovered that the two technologies can be combined to eliminate each other's drawbacks. This invention was accomplished on the basis of this discovery.

Moreover, since the invention adopts the method of heating cut labels by moving them in contact with a linear heat source, the time required for fusing the adhesive is greatly reduced, whereby the time required for producing labels is shortened.

SUMMARY OF THE INVENTION

It is an object of the present invention to overcome the aforesaid problems of the prior art by providing a method for printing heat sealing labels which, by enabling heat sealing labels to be printed without degrading printing quality or processing speed, is advantageous in terms of economy and the conservation of natural resources.

Another object of the invention is to provide a printer for conducting the method.

For achieving these objects, the invention provides a method for printing heat sealing labels comprising the steps of using an ink jet printer to print ink onto a printing surface of a heat sealing label strip having the printing surface on a first side and having on a second side a surface coated with an adhesive, and heating the heat sealing label strip to fuse the adhesive on the surface of the second side and simultaneously dry the ink printed on the printing surface.

For carrying out this method, the invention further provides a printer for printing heat sealing labels comprising an ink jet printer for printing ink onto a printing surface of a heat sealing label strip having the printing surface on a first side and having on a second side a surface coated with an adhesive, and heating means for simultaneously fusing the adhesive on the surface on the second side and drying ink printed on the printing surface by the printer.

With the method and printer according to this invention, the drying of the normally slow-drying ink jet type ink is accelerated, making it possible to preclude ink blotting and obtain a label with good quality printing. Moreover, as no additional time is required for drying the ink, the heat sealing labels can be processed just as rapidly as the conventional labels attached to a backing sheet.

In addition, a high heating efficiency is realized by using a heating means comprising a heating roller and a pressure roller pressing against the heating roller and passing the printed heat sealing label between the heating roller and the pressure roller. It is therefore possible to dry bar codes and other types of printing which require several times the drying time of ordinary characters effectively. Further, an excess adhesive removing member (cleaning pad) is provided in contact with the heating roller for removing excess adhesive therefrom while an excess ink removing member is provided in contact with the pressure roller for removing excess ink therefrom. There is therefore no danger of later processed labels being fouled with adhesive or ink from earlier processed ones.

Other features and advantages of the present invention will become apparent from the following description of the invention which refers to the accompanying drawings.

BRIEF DESCRIPTION OF THE DRAWING(S)

DETAILED DESCRIPTION OF THE PREFERRED EMBODIMENTS

Preferred embodiments of the method and the printer for printing heat sealing labels according to this invention will now be explained in detail with reference to the drawings.

Figure 1:
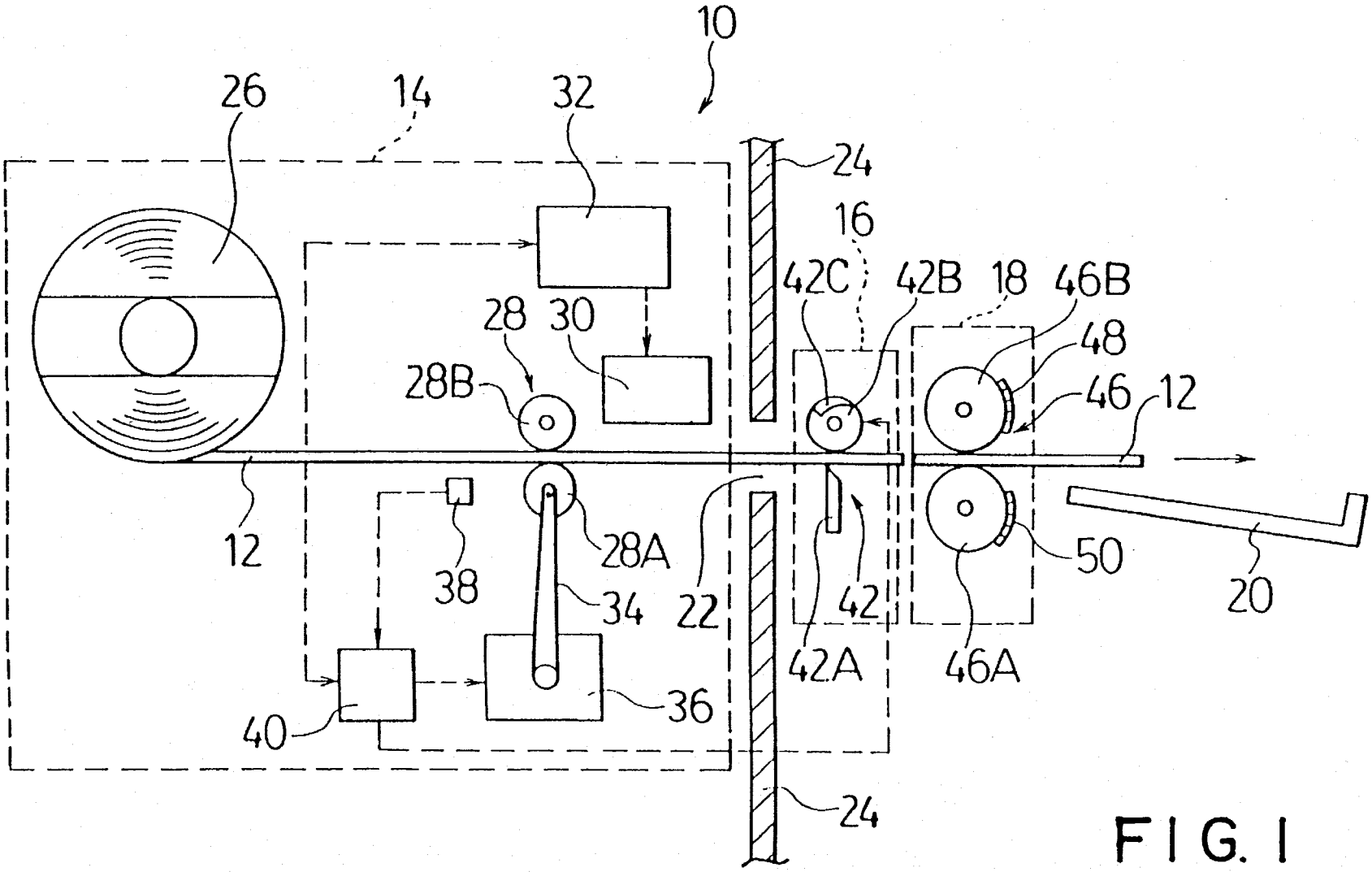
FIG. 1 is a schematic view showing the overall configuration of a heat sealing label printer according to the invention.

FIG. 1 shows the overall configuration of a heat sealing label printer 10 according to the invention. The heat sealing label printer 10 is comprised mainly of an ink jet printer unit 14 for printing a heat sealing label strip 12 having a printing surface on the front and coated with adhesive on the back, a cutter unit 16 for cutting the printed heat sealing label strip 12 into individual labels of prescribed length, a heating unit 18 for heating the individual labels cut from the heat sealing label strip 12 so as to fuse the adhesive coating to an adhesive state and simultaneously dry the printing ink, and a label receiver 20 for receiving the heat-treated heat sealing labels. In addition, a heat insulating panel 24 with an opening 22 for passage of the heat sealing label strip 12 is provided between the ink jet printer unit 14 and the cutter unit 16 so that the ink jet printer unit 14 will not be affected by heat from the heating unit 18.

Figure 2:
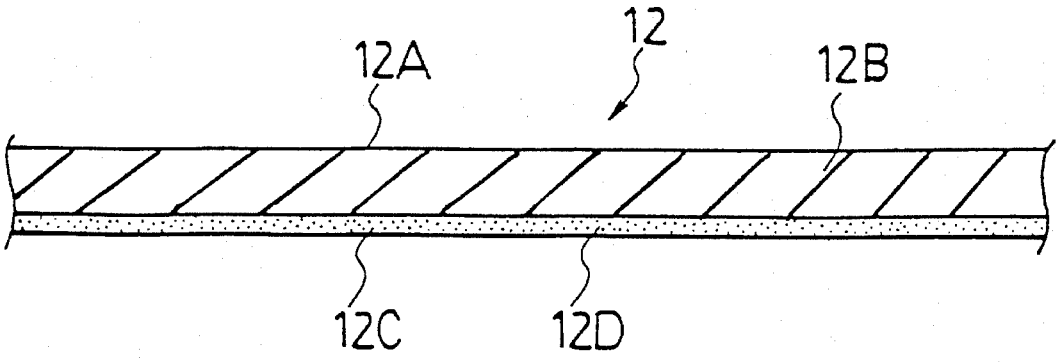
FIG. 2 is an enlarged sectional view of a heat sealing label.
Figure 3:
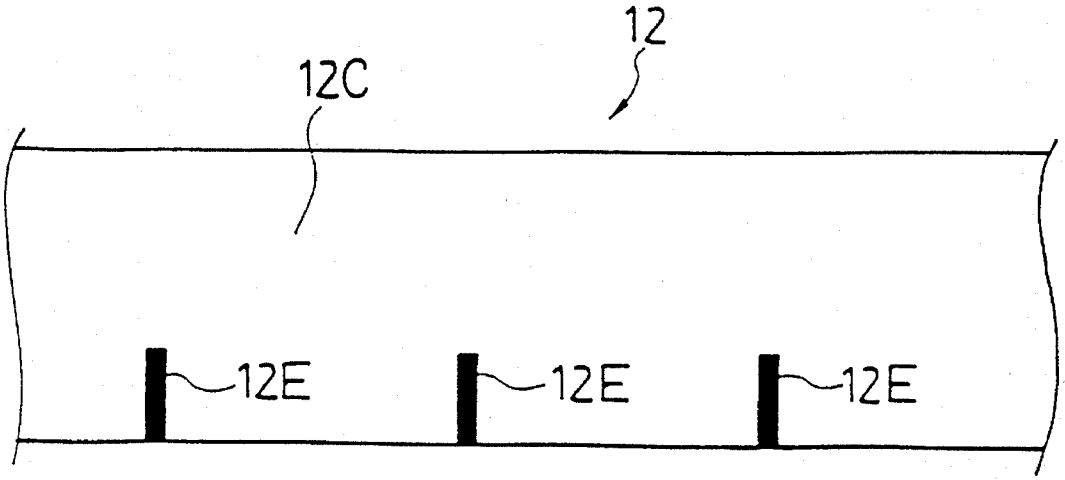
FIG. 3 is a rear view of a heat sealing label showing detection marks printed on its attachment surface.

As shown in FIG. 2, the heat sealing label strip 12 consists of a base paper 12B (coated paper or the like) providing a printing surface 12A and formed on its attachment (back) surface 12C with an adhesive coating 12D. The adhesive coating 12D is not ordinarily sticky but manifests adhesiveness when fused by heating. Further, as shown in FIG. 3, detection marks 12E are printed on the printing surface 12A of the heat sealing label strip 12 at intervals equal to the length of a single label. The detection marks 12E are detected by a reflection sensor to be explained later and the detection signal is used for controlling the feed amount of the heat sealing label strip 12 for each printing operation.

As shown in FIG. 1, the ink jet printer unit 14 has a supply reel 26 loaded with a roll of heat sealing label strip 12 and the heat sealing label strip 12 is fed past an ink jet head 30 by a conveyance roller unit 28. The ink jet head 30 prints the heat sealing label strip 12 with a product name, date, bar code and the like by jetting ink onto the printing surface 12A in accordance with printing information from a printing data unit 32 connected with printing controller 40 to be explained later. The conveyance roller unit 28 comprises a drive roller 28A and a driven roller 28B. The conveyance roller unit 28 is rotated by a stepping motor 36 through an endless belt 34 and the driven roller 28B is driven by pressure contact with the rotating drive roller 28A. A reflection type sensor 38 is disposed between the supply reel 26 and the conveyance roller unit 28 for detecting the detection marks 12E printed on the heat sealing label strip 12 and forwarding detection signals to the printing controller 40. When the printing controller 40 receives a detection signal, it operates the stepping motor 36 for a prescribed period of time and the rotation of the stepping motor 36 is transmitted to the drive roller 28A through the endless belt 34. As a result, the drive roller 28A and the driven roller 28B convey the heat sealing label strip 12 to the position of the ink jet head 30 in the prescribed amount for a single printing operation and the so-fed portion of the heat sealing label strip 12 is printed by the ink jet head 30.

The portion of the heat sealing label strip 12 printed by the ink jet head 30 is next conveyed to a rotary cutter unit 42 comprising a part of the cutter unit 16. The rotary cutter unit 42 consists of a fixed blade 42A and a rotary blade 42B respectively positioned below and above the path of the heat sealing label strip 12. The rotary cutter unit 42 is connected with the printing controller 40 and is controlled thereby such that the rotary blade 42B disposed opposite the fixed blade 42A of the rotary cutter unit 42 is rotated to cut a label of prescribed length from the heat sealing label strip 12 each time the reflection type sensor 38 detects one of the detection marks 12E printed thereon. At the time the label is cut from the heat sealing label strip 12, its leading end is positioned inside the heating unit 18 where its leading end is caught between a heating roller 46A and a pressure roller 46B of a heating roller unit 46. Since the heating unit 18 is located near the cutter unit 16, the printed labels cut from the heat sealing label strip 12 are conveyed between the heating roller 46A and the pressure roller 46B shortly after being printed.

Figure 4:
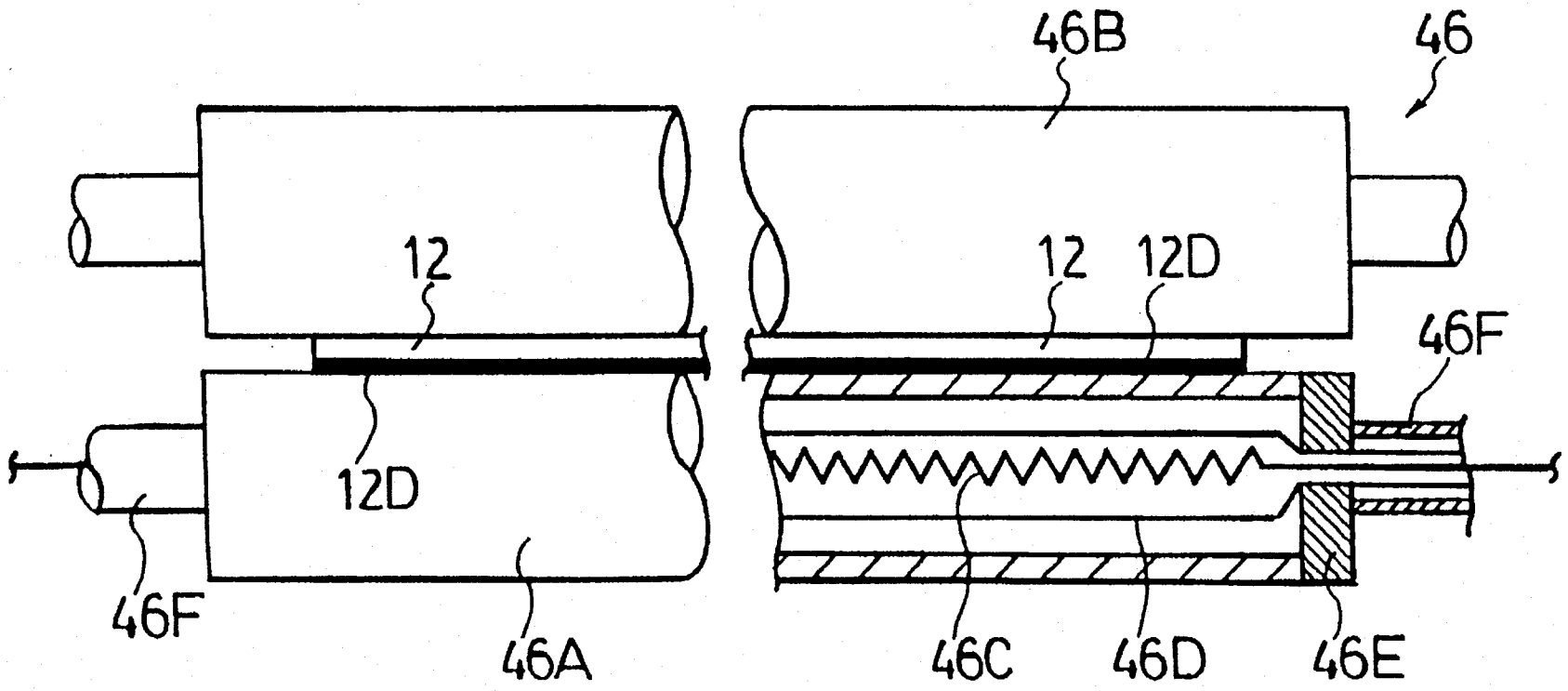
FIG. 4 is an explanatory view, partially in section, showing a portion of a heating roller unit of a heat sealing label printer according to the invention.

As shown in FIGS. 1 and 4, the label cut from the heat sealing label strip 12 by the cutter unit 16 is forwarded to the heating roller unit 46 of the heating unit 18. The heating roller 46A of the heating roller unit 46 is a drive roller positioned below the cut label, i.e. on the attachment surface 12C side thereof, and the pressure roller 46B is a driven roller positioned above the cut label. The pressure roller 46B presses down on the heating roller 46A and is rotated thereby. As shown in FIG. 4, the heating roller 46A is a hollow cylinder whose hollow interior houses an axially oriented heating tube 46D having a heating wire 46C. One end of the heating wire 46C passes out of the heating roller 46A through a hollow shaft 46F fixed on an end plate 46E of the heating roller 46A and is connected with a temperature controller (not shown). The temperature controller controls the surface temperature of the heating roller 46A to 80°–100° C. The label cut from the heat sealing label strip 12 in the cutter unit 16 is conveyed between the heated heating roller 46A and the pressure roller 46B. The heating unit 18 fuses the adhesive coating 12D on the heat sealing label into an adhesive state and simultaneously dries the still wet ink jet printing on the printing surface 12A of the label. However, it does not fuse the printing.

The surfaces of the heating roller 46A and the pressure roller 46B are coated with Teflon for suppressing adherence of adhesive and ink thereto. In addition, as shown in FIG. 1, a cleaner pad 50 made of felt impregnated with silicone is provided in contact with about ¼ of the periphery of the roller 46A and an identical cleaner pad 48 is similarly provided in contact with the roller 46B.

The operation of the heat sealing label printer 10 constituted in the foregoing manner will now be explained.

Based on the detection signals from the reflection type sensor 38, the conveyance roller unit 28 intermittently conveys the heat sealing label strip 12 from the supply reel 26 to the ink jet head 30 in lengths equal to the amount of the heat sealing label strip 12 required for printing a single label. In response to each detection signal received from the printing controller 40, the ink jet head 30 jets ink in accordance with the printing information received from the printing data unit 32, thereby printing a product name, date, bar code and other required information on the printing surface 12A of the heat sealing label strip 12.

The printed portion of the heat sealing label strip 12, which corresponds to a single label, is then sent to the cutter unit 16 through the opening 22 in the heat insulating panel 24. The printing controller 40 determines the position at which the heat sealing label strip 12 is to be cut from the distance between the conveyance roller unit 28 and the rotary cutter unit 42 (which distance is stored in a memory of the printing controller 40) and operates the rotary cutter unit 42 to cut the printed label from the heat sealing label strip 12.

The cut heat sealing label is then conveyed to the heating unit 18 where it is heated while being conveyed between the heating roller 46A and the pressure roller 46B. More specifically, the label's attachment surface 12C (having the-adhesive coating 12D) is brought in contact with the heating roller 46A, which is heated to about 80°–100° C., thereby fusing the adhesive coating 12D to an adhesive state. Simultaneously, the printing surface 12A of the label receives heat from its contact with the pressure roller 46B, which has been warmed by the heating roller 46A, and also receives heat passing through the label from the heating roller 46A. As a result, the ink printed on the printing surface 12A is dried.

Thus, since the heat used for fusing the adhesive coating 12D of the label is also used for drying the printing ink, the drying of the normally slow-drying ink jet type ink is accelerated, making it possible to preclude ink blotting and obtain a label with good quality printing. As no additional time is required for drying the ink, moreover, the heat sealing labels can be processed just as rapidly as the conventional labels attached to a backing sheet.

Owing to its high heating efficiency, the heating roller unit 46 used in the heating unit 18 is effective even for drying bar codes and other types of printing which require several times the drying time of ordinary characters. Further, since any excess adhesive from the back side of the label adhering to the heating roller 46A is wiped off by the cleaner pad 50 and any excess ink remaining on the front side is wiped off by the cleaner pad 48, there is no danger of later processed labels being fouled with adhesive or ink from earlier processed ones. The cleaner pad 48 (for removing excess ink) and the cleaner pad 50 (for removing excess adhesive) can be replaced when they become too fouled to fulfill their purpose.

The heat-treated label is received by the label receiver 20 (label issuing) and then attached to an article to be labeled by hand or by a label suction device for this purpose.

The heat sealing label printer 10 according to the invention is thus able to use heat sealing labels, which has not heretofore been possible with thermal and thermal transfer type printers. What is more, it overcomes the problems of low processing speed and printing quality degradation by ink blotting that have been drawbacks of the ink jet type printer.

The ability of the heat sealing label printer according to this invention to use inexpensive, environmentally friendly heat sealing labels while ensuring excellent printing quality and no reduction in label processing speed makes it the ideal printer for this type of label, especially in light of the improvement in economy and natural resource utilization it achieves.

While the embodiment described in the foregoing uses a heating unit 18 equipped with the heating roller unit 46, it is possible instead to make the heating unit 18 as a tunnel type hot air drier. In fact, any type of heating device will do insofar as it is capable of quickly fusing the adhesive and drying the ink with high heat utilization efficiency.

If it is desired to take up the printed heat sealing label strip on a separate reel (not shown) without fusing the adhesive coating 12D, it suffices to lower the temperature of the heating roller 46A so that only the ink is dried and disable the cutter unit 16.

Since the heat used for fusing the adhesive of the label is also used for drying the printing ink, the drying of the normally slow drying ink jet type ink is accelerated, making it possible to preclude ink blotting and obtain a label with good quality printing as well as to maintain the same label processing speed with heat sealing labels as can be achieved using conventional labels attached to a backing strip.

The heat sealing label printer according to the invention is thus able to use heat sealing labels, which has not heretofore been possible with thermal and thermal transfer type printers. What is more, it overcomes the problems of low processing speed and printing quality degradation by ink blotting that have been drawbacks of the ink jet type printer.

Moreover, a high heating efficiency is realized by using a heating means comprising a heating roller and a pressure roller pressing against the heating roller and passing the printed heat sealing label between the heating roller and the pressure roller, and, therefore, it is possible to dry bar codes, and other types of printing which require several times the drying time of ordinary characters effectively. Further, since any excess adhesive from the back side of the label adhering to the heating roller 46A is wiped off by the cleaner pad 50 and any excess ink from the front side adhering to the pressure roller 46B is wiped off by the cleaner pad 48, there is no danger of later labels being fouled with adhesive or ink from earlier ones.

Since it is able to use inexpensive heat sealing labels that help to reduce the consumption of natural resources, the label printer according to this invention is characterized by both improved economy and enhanced environment friendliness.

Although the present invention has been described in relation to particular embodiments thereof, many other variations and modifications and other uses will become apparent to those skilled in the art. Therefore, the present invention should be limited not by the specific disclosure herein, but only by the appended claims.

What is claimed is:

1. A method for printing heat sealing labels comprising the steps of:

applying ink with an ink jet printer onto a printing surface of a heat sealing label strip having the printing surface on a first side and having on a second side a surface coated with an adhesive; and heating the heat sealing label strip to fuse the adhesive on the surface on a second side and simultaneously dry the ink printed on the printing surface on the first side.

2. The method according to claim 1, further comprising cutting said label strip into individual labels.

3. The method according to claim 2, further comprising cutting said label strip into individual labels prior to said step of heating.

4. The method according to claim 1, wherein said step of heating comprises using heat of a sufficient temperature to dry said ink and simultaneously fuse the adhesive so that the adhesive becomes tacky.

5. The method according to claim 4, wherein the temperature is approximately 80°–100° C.

6. The method according to claim 1, wherein said step of heating comprises heating the label strip between a heating roller and a pressure roller.

7. The method according to claim 6, further comprising cleaning surfaces of said pressure roller and heating roller.

8. The method according to claim 7, wherein the heating roller engages the second side and the pressure roller engages the first side and the steps of cleaning comprise cleaning the pressure roller of ink and cleaning the heating roller of adhesive.

9. A method for printing heat sealing labels comprising the steps of:

applying ink with an ink jet printer onto a printing surface of a heat sealing label strip having the printing surface on a first side and having on a second side a surface coated with an adhesive; and heating the heat sealing label strip to dry the ink printed on the printing surface on the first side.

10. The method according to claim 9, further comprising cutting said label strip into individual labels.

11. The method according to claim 10, further comprising cutting said label strip into individual labels prior to said step of heating.

12. The method according to claim 10, further comprising heating the heat sealing labels to a temperature sufficient to fuse the adhesive on the second side to an adhesive state.

13. The method according to claim 12, wherein the temperature is approximately 80°–100° C.

14. The method according to claim 9, further comprising receiving the labels on the strip uncut from the strip on a collection device.

15. The method according to claim 9, wherein said step of heating comprises heating the label strip between a heating roller and a pressure roller.

16. The method according to claim 15, further comprising cleaning surfaces of said pressure roller and heating roller.

17. The method according to claim 16, wherein the heating roller engages the second side and the pressure roller engages the first side and the steps of cleaning comprise cleaning the pressure roller of ink and cleaning the heating roller of adhesive.

18. The method according to claim 9, wherein said step of heating comprises using heat of a sufficient temperature to dry said ink but which is not sufficiently hot to fuse the adhesive so that the adhesive becomes tacky.

19. The method according to claim 12, wherein the temperature is below about 80° C.

20. A printer for printing heat sealing labels comprising:

an ink jet printer for printing ink onto a printing surface of a heat sealing label strip having a first side with the printing surface thereon and having a second side with a surface coated with an adhesive; and a heater comprising a heating element positioned on the second side of the heat sealing label strip, for simultaneously fusing the adhesive on the surface on the second side and drying ink printed on the printing surface on the first side by the printer.

21. The printer for printing heat sealing labels according to claim 20, further comprising a cutter for cutting the heat sealing label strip into individual labels, the cutter being disposed between the printer and the heater.

22. The printer for printing heat sealing labels according to claim 20, wherein the heater comprises a heating roller and a pressure roller pressing against the heating roller and the heat sealing label strip is passed between the heating roller and the pressure roller.

23. The printer for printing heat sealing labels according to claim 22, further comprising an excess adhesive removing member in contact with the heating roller for removing excess adhesive therefrom and an excess ink removing member in contact with the pressure roller for removing excess ink therefrom.

24. The printer for printing heat scaling labels according to claim 22, wherein the heating roller engages the second side and the pressure roller engages the first side.

25. The printer for printing heat sealing labels according to claim 20, wherein the heater comprises a heater for providing heat of a sufficient temperature to dry said ink and simultaneously fuse the adhesive so that the adhesive becomes tacky.

26. The printer for printing heat sealing labels according to claim 25, wherein the temperature is approximately 80°–100° C.

27. A printer for printing heat sealing labels comprising:

a heat sealing label strip having a first side with a printing surface and having a second side with a surface coated with a heat activated adhesive;

an ink jet printer for printing ink onto the printing surface of the heat sealing label strip; and heating means for simultaneously fusing the adhesive on the surface on the second side and drying ink printed on the printing surface on the first side by the printer.

28. The printer for printing heat sealing labels according to claim 27, further comprising cutting means for cutting the heat sealing label strip into individual labels, the cutting means being disposed between the printer and the heating means.

29. The printer for printing heat sealing labels according to claim 27, wherein the heating means comprises a heating roller and a pressure roller pressing against the heating roller and the heat sealing label strip is passed between the heating roller and the pressure roller.

30. The printer for printing heat sealing labels according to claim 29, further comprising an excess adhesive removing member in contact with the heating roller for removing excess adhesive therefrom and an excess ink removing member in contact with the pressure roller for removing excess ink therefrom.

31. The printer for printing heat scaling labels according to claim 29, wherein the heating roller engages the second side and the pressure roller engage the first side.

32. The printer for printing heat sealing labels according to claim 27, wherein the heating means comprises a heater for providing heat of a sufficient temperature to dry said ink and simultaneously fuse the adhesive so that the adhesive becomes tacky.

33. The printer for printing heat sealing labels according to claim 32, wherein the temperature is approximately 80°–100° C.

34. A printer for printing heat sealing labels comprising:

a heat sealing label strip having a first side with a printing surface and having a second side with a surface coated with a heat activated adhesive;

an ink jet printer for printing ink onto the printing surface of the heat sealing label strip; and a heater comprising a heating element, positioned on the second side of the heat sealing label strip, for drying ink printed on the printing surface on the first side by the printer.

35. The printer for printing heat sealing labels according to claim 34, further comprising a cutter for cutting the heat sealing label strip into individual labels, the cutter being disposed between the printer and the heater.

36. The printer for printing heat sealing labels according to claim 35, further wherein the heater comprises a heater for providing heat sufficient to fuse the adhesive to an adhesive state.

37. The printer for printing heat sealing labels according to claim 36, wherein the temperature is approximately 80°–100° C.

38. The printer for printing heat sealing labels according to claim 34, wherein the heater comprises a heater producing heat of a sufficient temperature to dry said ink but which is not sufficient to fuse the adhesive so that the adhesive becomes tacky.

39. The printer for printing heat sealing labels according to claim 38, wherein the temperature is below about 80° C.

40. The printer for printing heat sealing labels according to claim 39, further comprising means for receiving the labels on the strip uncut from the strip for storage.

41. The printer for printing heat sealing labels according to claim 34, wherein the heater comprises a heating roller and a pressure roller pressing against the heating roller and the heat sealing label strip is passed between the heating roller and the pressure roller.

42. The printer for printing heat sealing labels according to claim 41, further comprising an excess adhesive removing member in contact with the heating roller for removing excess adhesive therefrom and an excess ink removing member in contact with the pressure roller for removing excess ink therefrom.

43. The printer for printing heat sealing labels according to claim 41, wherein the heating roller engages the second side and the pressure roller engages the first side.

* * * * *